US007964781B1

(12) United States Patent
Lovvorn et al.

(10) Patent No.: US 7,964,781 B1
(45) Date of Patent: Jun. 21, 2011

(54) ROTATING MULTI-STEM INSTRUMENT BRACKET

(75) Inventors: Randy Lovvorn, Irving, TX (US); Andrzej Krol, Wayne, NJ (US); Ray Enhoffer, Clifton, NJ (US); Richard Simons, Garfield, NJ (US)

(73) Assignee: KMC Music, Inc., Bloomfield, CT (US)

( * ) Notice: Subject to any disclaimer, the term of this patent is extended or adjusted under 35 U.S.C. 154(b) by 0 days.

(21) Appl. No.: 12/687,799

(22) Filed: Jan. 14, 2010

(51) Int. Cl.
*G10D 13/02* (2006.01)

(52) U.S. Cl. ..... 84/421; 84/327; 84/422.2

(58) Field of Classification Search ..... 84/421, 84/327, 422.2
See application file for complete search history.

(56) References Cited

U.S. PATENT DOCUMENTS

| | | | | | |
|---|---|---|---|---|---|
| 1,045,583 | A | * | 11/1912 | Mills | 211/85.6 |
| 2,455,821 | A | * | 12/1948 | Stenger | 211/85.6 |
| 2,559,739 | A | * | 7/1951 | Sherman | 211/70 |
| 3,677,128 | A | | 7/1972 | Simpson | |
| 3,893,363 | A | * | 7/1975 | Cohen | 84/402 |
| 4,126,075 | A | * | 11/1978 | Kurosaki | 84/421 |
| 4,510,838 | A | * | 4/1985 | Alexis, Jr. | 84/422.3 |
| 4,520,710 | A | | 6/1985 | Elliott, Jr. | |
| 4,987,817 | A | * | 1/1991 | Diaz | 84/421 |
| 5,454,473 | A | * | 10/1995 | Hennessey | 211/85.6 |
| 5,467,680 | A | * | 11/1995 | Kurosaki | 84/421 |
| 5,804,747 | A | * | 9/1998 | Chen | 84/327 |
| 6,091,011 | A | * | 7/2000 | Simons et al. | 84/421 |
| 6,225,543 | B1 | | 5/2001 | Miguel | |
| 6,307,136 | B1 | | 10/2001 | Sikra et al. | |
| D462,711 | S | * | 9/2002 | Arsala | D17/22 |
| 6,484,977 | B1 | * | 11/2002 | Yu | 248/125.1 |
| 6,545,204 | B1 | | 4/2003 | Wadell | |
| 6,685,145 | B2 | * | 2/2004 | Mackay et al. | 248/125.1 |
| 7,115,805 | B1 | | 10/2006 | Vandervoort | |
| 7,268,284 | B2 | | 9/2007 | Lee | |
| 7,291,775 | B2 | * | 11/2007 | Yu | 84/327 |
| 7,300,027 | B2 | * | 11/2007 | Walker | 248/121 |
| 7,399,916 | B1 | | 7/2008 | Lombardi | |
| 7,468,480 | B1 | * | 12/2008 | Sikra | 84/421 |
| 7,525,039 | B2 | | 4/2009 | Steele | |
| 2003/0173484 | A1 | * | 9/2003 | Hsieh | 248/291.1 |
| 2006/0016952 | A1 | * | 1/2006 | Workman | 248/443 |
| 2007/0234875 | A1 | | 10/2007 | Fisher, IV | |
| 2008/0163739 | A1 | | 7/2008 | Mori | |

FOREIGN PATENT DOCUMENTS

DE 3833568 A1 * 4/1990

* cited by examiner

*Primary Examiner* — Jeffrey Donels
*Assistant Examiner* — Robert W Horn
(74) *Attorney, Agent, or Firm* — Hudnell Law Group P.C.

(57) ABSTRACT

An assembly for mounting musical instruments comprises a base, a bearing, the bearing secured to the base, a post, the post comprising a head, the head comprising a plurality of mounting flanges for mounting a musical instrument, and a body, the body fixedly connected to head at a first end, the body further rotatably engaged to the bearing at a second end.

11 Claims, 3 Drawing Sheets

ROTATING MULTI-STEM INSTRUMENT BRACKET

BACKGROUND

Some percussive musical instruments such as cowbells and wood blocks are normally played by holding the instrument in one hand while striking them with a stick, striker, or mallet held in the other hand. Alternatively, such percussive instruments are sometimes mounted on a support that holds the instrument in place so the percussionist can play it using a single hand.

Foot pedals are mechanisms that allow a percussionist to step on a lever that causes a striker or mallet to strike a percussive instrument. A familiar application of percussive foot pedals is in a typical drum kit, where the drummer plays the bass drum with a foot pedal, also known as a kick pedal. Some drum kits include a second pedal so the drummer can play the bass drum with the opposite foot as well, or to open and close a hi-hat cymbal.

SUMMARY

This invention relates to percussive musical instruments, and more particularly to a rotatable bracket that holds multiple percussion instruments. In a first aspect, an assembly for mounting musical instruments comprises a base, a bearing, the bearing secured to the base, a post, the post comprising a head, the head comprising a plurality of mounting flanges for mounting a musical instrument, and a body, the body fixedly connected to head at a first end, the body further rotatably engaged to the bearing at a second end.

Implementations can include some, all, or none of the following features. The musical instrument can be a percussion instrument. The head can be Y-shaped. The base can be detachably connected to a foot pedal. Furthermore, the base can include a tooth, the second end of the body can include a plurality of recesses, each recess corresponding to one of the flanges, each recess further engagable with the tooth so that the body may be stabilized in a position where an instrument mounted to the flange is aligned with the foot pedal. The body can be a substantially hollow cylindrical tube. The bearing can be cylindrical. The inner cavity of the body can mate with the outer housing of the bearing. The assembly can further comprise a rod, the rod detachably connected to the flange, and wherein a musical instrument can be mounted to the rod.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
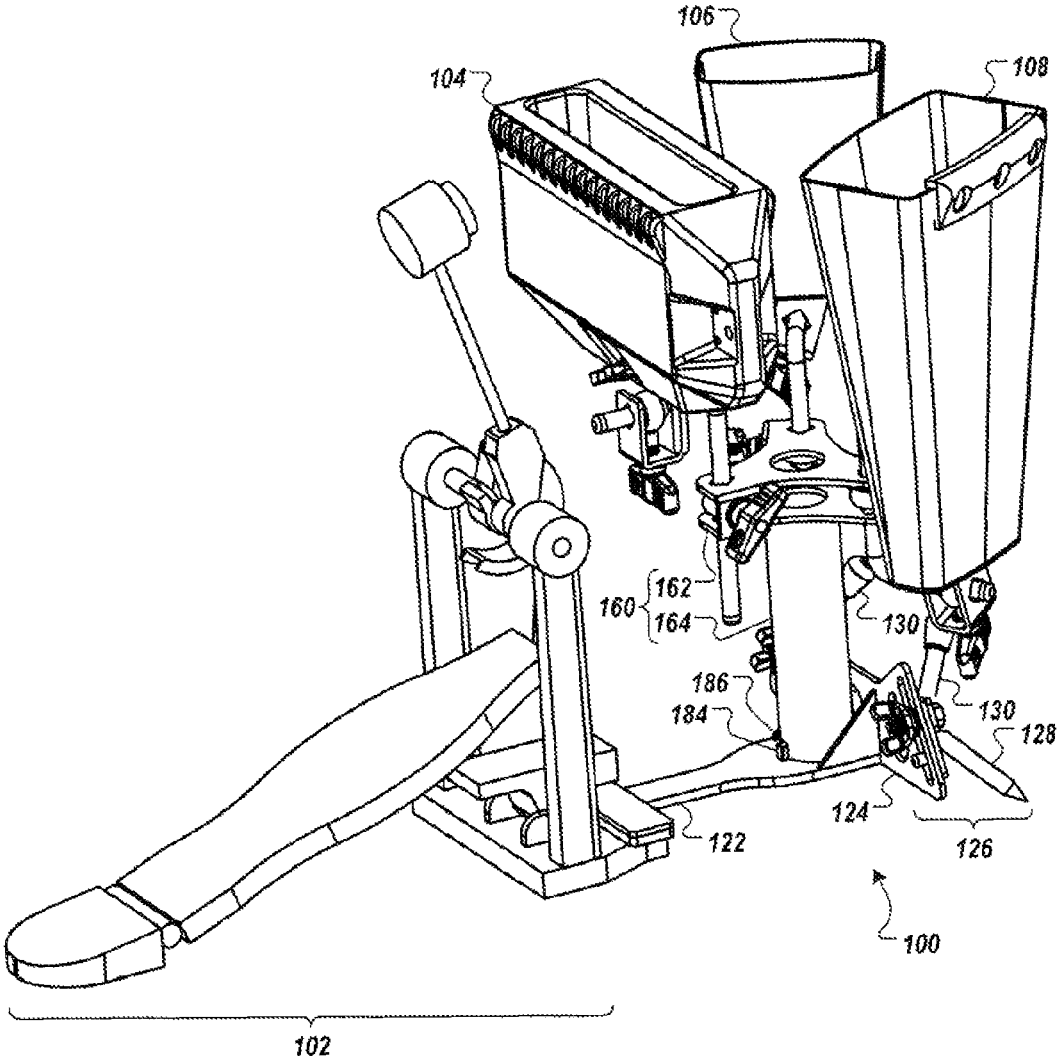
FIG. 1 illustrates an example rotating multi-stem instrument bracket implemented in an example usage configuration.

FIG. 1 illustrates an example rotating multi-stem instrument bracket 100 implemented in an example usage configuration. In the illustrated configuration, the rotating multi-stem instrument bracket 100 is detachably connected to a foot pedal 102, and a collection of musical instruments such as a plastic (jam) block 104, a cowbell 106, and a cowbell 108.

In general, the rotating multi-stem instrument bracket 100 allows a percussionist to play a number of different musical instruments by operating the foot pedal 102. The percussionist may quickly select from among a collection of instruments by rotating the multi-stem instrument bracket 100, thereby aligning a selected instrument with the foot pedal 102.

Figure 2:
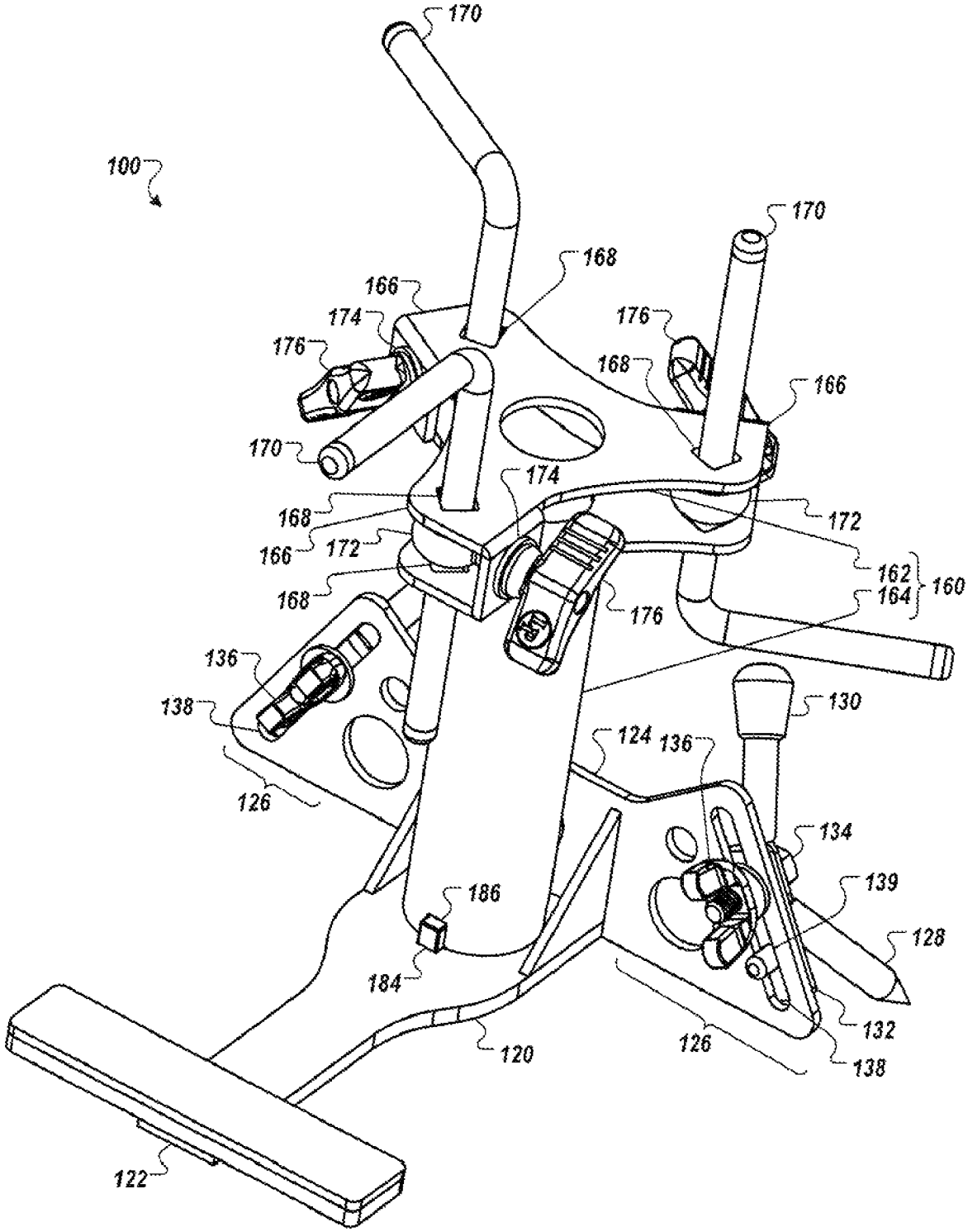
FIG. 2 shows a perspective view of the example rotating multi-stem instrument bracket.
Figure 3:
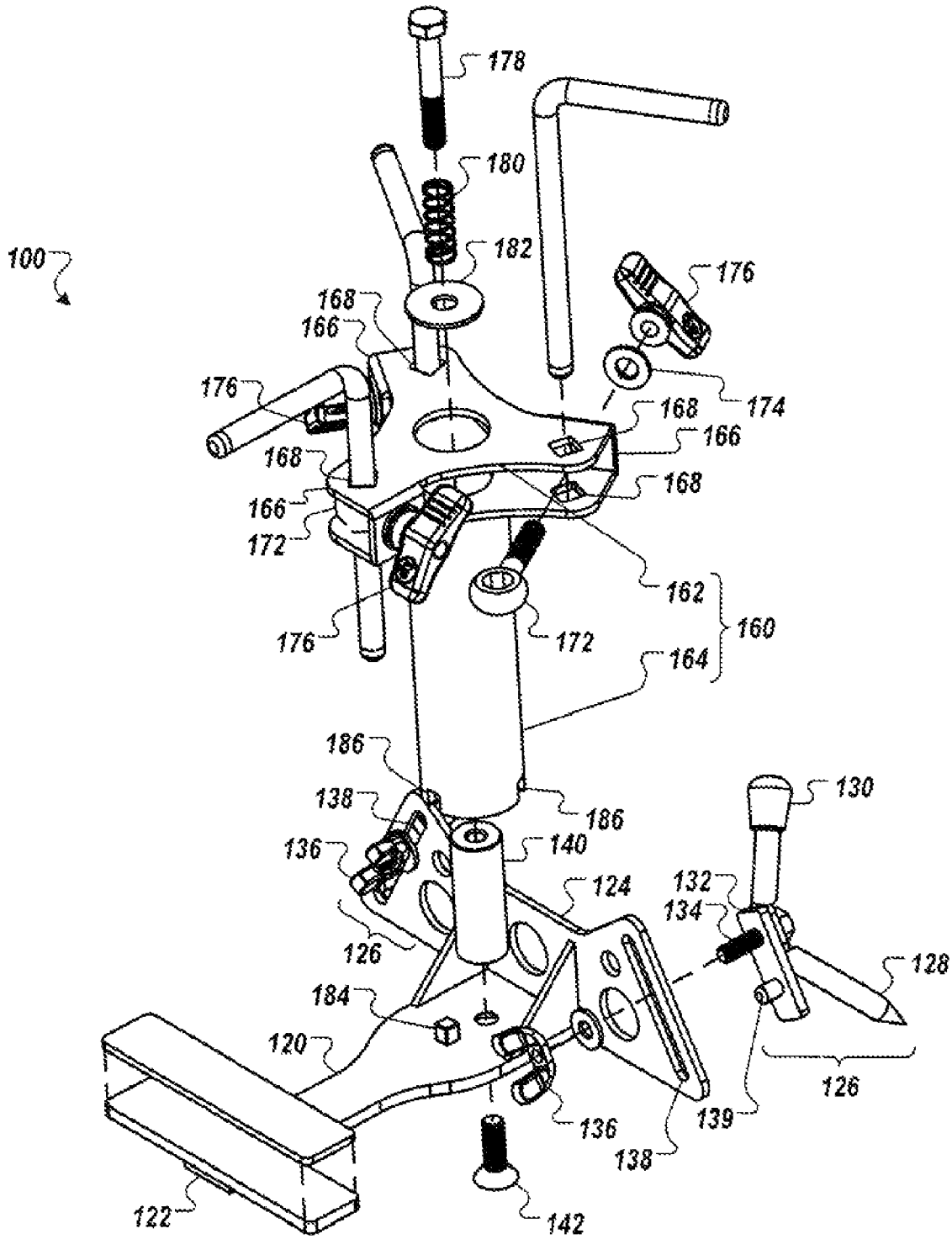
FIG. 3 shows an exploded view of the example rotating multi-stem instrument bracket.

FIG. 2 shows a perspective view of the example rotating multi-stem instrument bracket 100. FIG. 3 shows an exploded view of the example rotating multi-stem instrument bracket 100. Referring to both FIGS. 2 and 3, the rotating multi-stem instrument bracket 100 includes a base assembly 120, a bearing assembly 140 secured to the base assembly 120 by a bolt 142, and a post assembly 160.

The post assembly 160 includes a head assembly 162 and a body assembly 164. The head assembly 162 includes a collection of mounting flanges 166. In some embodiments, the mounting flanges 166 may be arranged in a substantially Y-shaped configuration, wherein three mounting flanges 166 radiate from the center of the head assembly 162, substantially equidistant from each other. Each of the mounting flanges 166 includes one or more holes 168, each through which a rod 170 is detachably mounted. In some implementations, musical instruments such the cowbells 106-108, the wood block 104, tambourines, sleigh bells, or other instruments may be affixed to the rods 170.

The rods 170 detachably connect to the flanges 166 by a collection of eyebolts 172. Each of the eyebolts 172 is inserted within the flange 166 so the eye of the eyebolt 172 aligns with the holes 168 in the flange 166. The rod 170 is then inserted through the holes 168 and the eye of the eyebolt 172. A washer 174 is placed on the threaded end of the eyebolt 172, and a wingnut 174 is threaded thereupon. As the wingnut 174 is tightened, the eye of the eyebolt 172 and the rod 170, inserted therethrough, are drawn laterally causing the rod 170 to be compresses against the edge of the hole 168. In some embodiments, this compressive force can hold the rod 170, and any musical instrument attached to it, substantially rigid relative to the flange 166.

The body assembly 164 is fixedly connected to the head assembly 162 at an upper end and rotatably engaged to the bearing 140 at a lower end. In some embodiments, the body assembly 164 and/or the bearing assembly 140 can be a substantially circular or polygonal cylinder. In some embodiments, the body assembly 164 may be substantially hollow. For example, the cylindrical or polygonal shape of the bearing assembly 140 may fit into a substantially cylindrical cavity within the body assembly 164 such that the body assembly 164 may rotate about the bearing assembly.

The post assembly 160 is rotatably connected to the bearing assembly 140 by a bolt 178 inserted through a coil spring 180 and a washer 182 and threaded into the bearing assembly 140. As the bolt 178 is tightened, the coil spring 180 compresses against the head of the bolt 178 and the post assembly 160, urging the bottom edge of the post assembly 140 to contact the base assembly 120. In some implementations, the bolt 178 may be tightened such that the coil spring 180 is not completely compressed. For example, if the coil spring 180 is not completely compressed, the percussionist may be able to lift up on the post assembly 160 against the force of the coil spring 180, causing the post assembly 160 to slide axially (upwardly) along the bearing assembly while limiting the post assembly's 160 total length of axial travel.

A tooth 184 extends upward from the base assembly 120, and aligns with a one of a collection of recesses 186 formed within the lower edge of the body assembly 164. Each of the recesses 186 is associated with one of the mounting flanges 166, and are positioned about the body assembly 164 such that when the tooth 184 is engaged with one of the recesses 186, the mounting flange 166 associated with the recess is substantially held in alignment with a foot section 122. In some implementations, when the tooth 184 is engaged with one of the recesses 186, the body assembly 164 may be substantially stabilized in a position where an instrument mounted to the mounting flange 166 may be played by the foot pedal 102.

Referring to FIG. 1 in use, the post assembly 160 can start with an initial instrument (e.g., the wood block 104) in alignment with the foot section 122, and in turn, the detachably connected foot pedal 102. The initial instrument is substantially held in alignment with the foot pedal 102 so the percussionist can play the initial instrument with his foot. The percussionist may then switch to an alternate instrument (e.g., one of the cowbells 106-108) by pulling up on the post assembly 160 to disengage the tooth 184 from the recess 186 (e.g., the recess 186 associated with the mounting flange 166 upon which the initial instrument is affixed), rotating the post assembly to align the selected instrument with the foot pedal 102, and then releasing the post assembly 160 so the tooth 184 engages the recess 186 associated with the mounting flange 166 upon which the selected instrument is affixed.

Referring once again to FIGS. 2 and 3, the base 120 further includes a mounting plate 124 connected substantially perpendicular to the base 120 for mounting a peg assembly 126 and to prevent the multi-stem instrument bracket 100 from tipping. Each peg assembly 126 includes a spiked peg 128 and a rubberized peg 130 rigidly connected to an alignment plate 132. The rotatable peg assemblies 126 are coupled to the mounting plate 124 by a pair of bolts 134 that pass through a pair of slots 138 and secured by a pair of wingnuts 136. Each alignment plate 132 includes an alignment peg 139 that engages the slot 138 to substantially prevent the peg assemblies 126 from rotating once the wingnuts 136 have been tightened.

In some implementations, the percussionist may use the peg assemblies 126 to select a stabilization method for the multi-stem instrument bracket 100. For example, the percussionist may loosen the wingnuts 136 and rotate and/or slide the rotatable peg assemblies 126 along the slots 138 so the spiked pegs 128 (e.g., to prevent the multi-stem instrument bracket 100 from sliding on soft surfaces such as grass or carpet) or the rubberized pegs 130 (e.g., to prevent the multi-stem instrument bracket 100 from sliding on hard surfaces such as tile or concrete) extend substantially below the plane of the base assembly 120. The percussionist may also rotate and/or slide the peg assemblies 126 along the slots 138 so neither the spiked pegs 128 nor the rubberized pegs 130 extend below the plane of the base assembly 120, thereby permitting the mounting plate 124 to substantially rest directly on the underlying surface. Once aligned as desired, the rotatable peg assemblies 126 may be substantially secured in position by tightening the wingnuts 136, drawing alignment pegs 139 into the slots 138.

A number of embodiments of the invention have been described. Nevertheless, it will be understood that various modifications may be made without departing from the spirit and scope of the invention. For example, the head assembly could include more than three mounting flanges. Or, the base assembly could have two posts side-by-side each comprising a multi-flange head assembly, which could be made wider to accommodate a double bass drum pedal. Accordingly, other embodiments are within the scope of the following claims.

What is claimed is:

1. An assembly for mounting musical instruments, comprising:

a base;

a bearing, the bearing secured to the base;

a post, the post comprising a head, the head comprising a plurality of mounting flanges for mounting a musical instrument, and a body, the body fixedly connected to head at a first end, the body further rotatably engaged to the bearing at a second end.

2. The assembly of claim 1 wherein the musical instrument is a percussion instrument.

3. The assembly of claim 1 wherein the head is Y-shaped.

4. The assembly of claim 1 wherein the base is detachably connected to a foot pedal.

5. The assembly of claim 4 wherein:

the base comprises a tooth;

the second end of the body comprises a plurality of recesses, each recess corresponding to one of the flanges, each recess further engagable with the tooth so that the body may be stabilized in a position where an instrument mounted to the flange is aligned with the foot pedal.

6. The assembly of claim 1 wherein the body is a substantially hollow cylindrical tube.

7. The assembly of claim 6 wherein the bearing is cylindrical.

8. The assembly of claim 7 wherein the inner cavity of the body mates with the outer housing of the bearing.

9. The assembly of claim 1 further comprising a rod, the rod detachably connected to the flange.

10. The assembly of claim 9 wherein a musical instrument is mounted to the rod.

11. The assembly of claim 1 further comprising:

a mounting plate, an alignment plate, the alignment plate detachably secured to the mounting plate, at least one peg, the peg secured to the alignment plate, the alignment plate capable of being mounted to the mounting plate such that peg stabilizes the assembly.

* * * * *